US011404184B2

(12) United States Patent
Ando et al.

(10) Patent No.: US 11,404,184 B2
(45) Date of Patent: Aug. 2, 2022

(54) BUSH STRUCTURE

(71) Applicant: Audio-Technica Corporation, Tokyo (JP)

(72) Inventors: Kozo Ando, Kanagawa (JP); Masaya Nakako, Tokyo (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 0 days.

(21) Appl. No.: 16/913,150

(22) Filed: Jun. 26, 2020

(65) Prior Publication Data

US 2021/0005359 A1 Jan. 7, 2021

(30) Foreign Application Priority Data

Jul. 1, 2019 (JP) ..... JP2019-122720

(51) Int. Cl.

| | |
|---|---|
| ***H01B 17/58*** | (2006.01) |
| ***H04R 1/10*** | (2006.01) |
| ***H01B 17/26*** | (2006.01) |
| ***H01B 17/60*** | (2006.01) |

(52) U.S. Cl.

CPC ..... *H01B 17/583* (2013.01); *H01B 17/265* (2013.01); *H01B 17/60* (2013.01); *H04R 1/1033* (2013.01)

(58) Field of Classification Search

CPC ..... H01B 17/26; H01B 17/583; H01B 17/60; H02G 3/22; H02G 3/083

See application file for complete search history.

(56) References Cited

U.S. PATENT DOCUMENTS

| | | | | |
|---|---|---|---|---|
| 4,077,636 | A * | 3/1978 | Langford | F16J 15/32 277/503 |
| 4,079,950 | A * | 3/1978 | Langford | F16J 15/32 277/569 |
| 5,071,143 | A * | 12/1991 | Byerly | H02G 3/22 277/606 |
| 5,639,993 | A * | 6/1997 | Ideno | B60R 16/0222 174/153 G |
| 6,051,795 | A * | 4/2000 | Fisher | H02G 3/081 16/2.1 |
| 6,519,828 | B1 * | 2/2003 | Cook | G01F 1/8413 228/135 |
| 7,992,876 | B2 * | 8/2011 | Akturk | G05G 25/04 277/634 |
| 8,661,614 | B2 * | 3/2014 | Allen | A61L 2/26 16/2.1 |
| 10,032,545 | B2 * | 7/2018 | Urbaniak | H02G 15/06 |

(Continued)

FOREIGN PATENT DOCUMENTS

JP 3209356 U 3/2017

*Primary Examiner* — Paresh Paghadal
(74) *Attorney, Agent, or Firm* — WCF IP

(57) ABSTRACT

For example, in an earphone in which left and right earphone units are connected by a cable and a remote part or a battery part is interposed on the cable, a bush structure is provided to a part where the cable is led out of the remote part and the like and suppresses the occurrence of disconnection in the vicinity of the lead-out part. The bush structure is provided to a lead-out part 5*a* of a cable 4 and includes a bush body 2 provided to the lead-out part and formed with a first through hole 2*a*2 where the cable is inserted. The first through hole gradually increases in diameter toward a lead-out direction of the cable.

4 Claims, 9 Drawing Sheets

(56) References Cited

U.S. PATENT DOCUMENTS

2005/0076469 A1* 4/2005 Tisbo ..... H02G 3/083
16/2.1
2005/0232568 A1* 10/2005 Maurin ..... B23B 31/102
385/137

* cited by examiner

BUSH STRUCTURE

TECHNICAL FIELD

The present invention relates to a bush structure. More particularly, the present invention relates to a bush structure, for example, in an earphone (referred to as a semi-wireless earphone) in which left and right earphone units are connected with a cable and a remote part or a battery part is interposed on the cable, and the bush structure is provided to a part where the cable is led out of the remote part and the like, and can suppress the occurrence of disconnection in the vicinity of the lead-out part.

BACKGROUND ART

In recent years, for example, a usage form of an earphone, in which a smart phone and an earphone are used by being connected in conformity with a short-distance wireless communication standard such as Bluetooth (registered trademark), has become widespread.

Examples of earphones using wireless communication include a semi-wireless earphone 50 having left and right earphone units 51 and 52, a cable 53 for physically connecting the left and right earphone units 51 and 52, and a remote part 54 interposed on the cable 53 as illustrated in FIG. 8.

Although not illustrated in the drawing, the remote part 54 is provided with a circuit board for a wireless connection with, for example, a smart phone, and a battery. Thus, the remote part 54 is heavier and larger in size than a remote part provided to a wired earphone in the relate art.

Note that, a circuit board and a battery part in some products are separated as disclosed in Japanese Utility Model Registration No. 3209356, but neither the circuit board nor the battery part has been downsized significantly.

SUMMARY OF INVENTION

Technical Problem

When the semi-wireless earphone is received in a bag, a pocket, and the like, generally the cable 53 is wound around the remote part 54, or the cable 53 is bundled in a ring shape as illustrated in FIG. 9, since the size of the remote part 54 is large as described above.

However, winding the cable 53 around the remote part 54 applies a load to bush bodies 55 at both ends of the remote part 54 and causes the cable 53 to be bent in the vicinity of a distal end of the bush body 55, resulting in a problem in that disconnection of the cable 53 easily occurs.

Particularly, as illustrated in a partial cross-sectional view of FIG. 10, in the case of a bush body 55 in a convex shape widely employed in the related art, the cable 53 is likely to be bent at an acute angle on the distal end side of the bush body 55 when the elasticity of the bush body 55 is high or the bush body 55 is stiff.

More specifically, when the semi-wireless earphone is received in a bag, a pocket, and the like, the shape of the bush does not change significantly and the cable 53 can be likely to bent at an acute angle as illustrated in FIG. 11A, even though the cable 53 is lightly wound around the remote part 54.

On the other hand, as illustrated in FIG. 11B, when the cable 53 is wound around the remote part 54 with a strong force to the extent that the bush body 55 is bent, the bending angle of the cable 53 can be loosened. However, since a large load is applied to the entire bush body 55, there is a problem in that the peripheral structure (attachment part and the like) of the bush body 55 can be easily damaged.

Furthermore, in order to prevent the cable 53 from being bent at an acute angle in the bush body 55, it is sufficient if the lead-out part of the cable has, for example, a bellows structure such that the bush body 55 is bent flexibly. However, in such a case, there is a problem in that the size of the bush body 55 needs to be further increased and the degree of freedom in designing the remote part 54 and the like is greatly reduced.

An object of the present invention is to solve the problem described above and to provide a bush structure in an earphone in which left and right earphone units are connected with a cable and a remote part or a battery part is interposed on the cable, and the bush structure is provided to a part where the cable is led out of the remote part and the like, and can suppress the occurrence of disconnection in the vicinity of the lead-out part.

Solution to Problem

In order to solve the aforementioned problems, the bush structure according to the present invention is a bush structure provided to a lead-out part of a cable and includes a bush body provided to the lead-out part and formed with a first through hole. The first through hole is a through hole where the cable is inserted, and gradually increases in diameter toward a lead-out direction of the cable.

Note that, preferably, an inner peripheral surface of the first through hole is formed to have a convex R shaped cross-section.

Furthermore, the bush structure according to the present invention includes a retaining part connected below the bush body. Preferably, the retaining part includes a second through hole, which communicates with the first through hole and into which the cable is inserted and fitted, and a locking part locked to the lead-out part.

Furthermore, preferably, the retaining part is made of a material harder than the bush body. For example, the bush body is made of thermoplastic elastomer and the retaining part is made of polypropylene.

As described above, in the bush structure according to the present invention, the lead-out part of the cable includes the through hole formed in a mortar shape with a diameter larger than the cable diameter and gradually increasing around the cable axis toward the lead-out direction of the cable.

Therefore, for example, when a user of a wireless earphone holds the remote part with one hand and winds the cable around the remote part with the other hand, the cable in the vicinity of the lead-out part comes into contact with the inner peripheral surface of the mortar-shaped first through hole with a long line width. Consequently, a load applied to the cable in the vicinity of the lead-out part is distributed, so that the disconnection of the cable is prevented. Furthermore, particularly, since the inner peripheral surface of the first through hole is formed to have a convex R shaped cross-section, the cable is led out in a loosely curved state, so that sharp bending of the cable is suppressed.

Furthermore, the shape of the bush body is not a convex shape protruding from the lead-out part of the cable, but a concave shape. Therefore, the remote part, to which the bush body is attached, is not subjected to design restrictions such that the lead-out part of the cable has a bellows structure. That is, the degree of freedom in designing the remote part and the like is increased, resulting in the improvement of the design property of a product including the remote part. Moreover, the bush body, which is disposed on a part where the cable is loaded, is formed to be soft, and the retaining part, which is disposed on a part where the cable is not loaded, is formed to be hard. Thus, the performance of preventing detachment of the bush structure is enhanced and the bush body absorbs a load applied to the cable.

Advantageous Effects of Invention

According to the present invention, a bush structure capable of suppressing the occurrence of disconnection in the vicinity of a lead-out part of a cable can be provided.

DESCRIPTION OF EMBODIMENTS

Embodiments of a bush structure according to the present invention will now be described with reference to the attached drawings.

Figure 1:
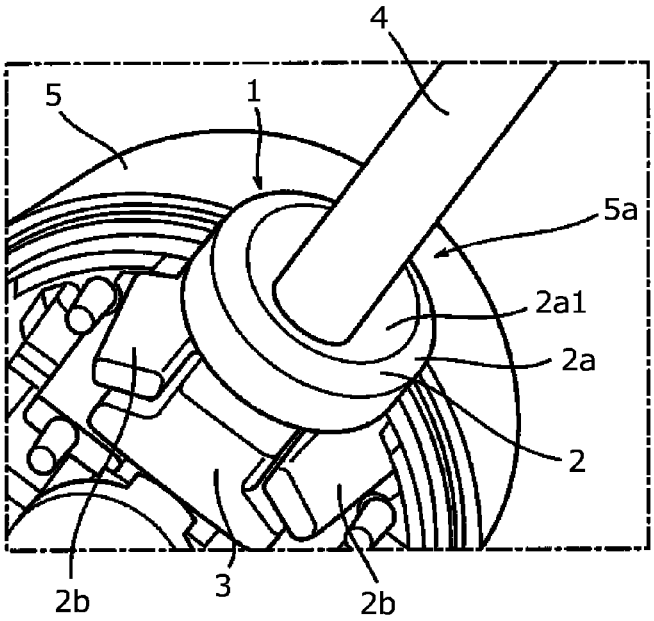
FIG. 1 is an enlarged perspective view illustrating a bush structure according to the present invention.
Figure 2:
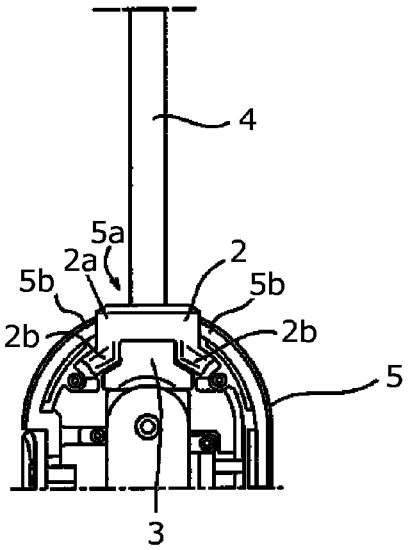
FIG. 2 is a side view of the bush structure according to the present invention.
Figure 3A:
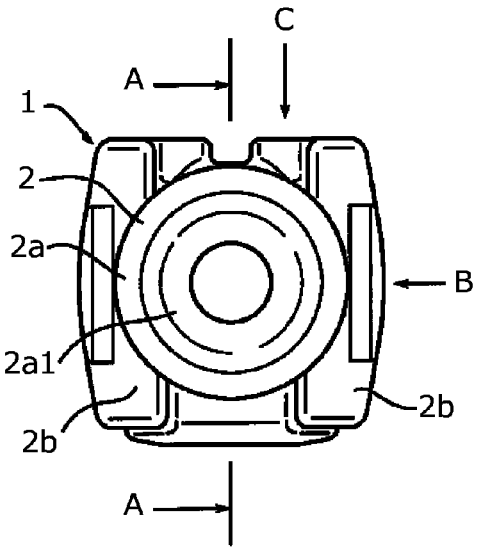
FIG. 3A is a plan view of a bush structure alone according to the present invention.
Figure 3B:
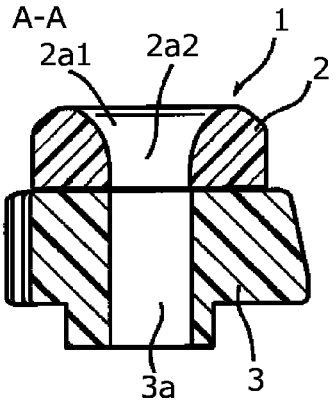
FIG. 3B is a cross-sectional view taken along an arrow A-A of FIG. 3A.
Figure 4A:
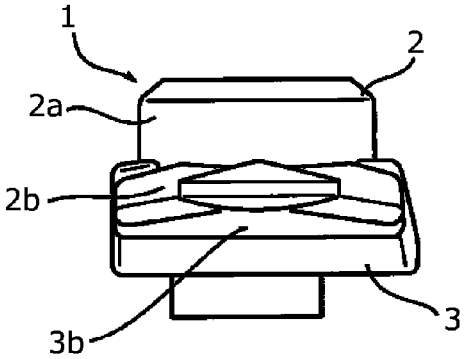
FIG. 4A is a side view taken along an arrow B of FIG. 3A.

FIG. 1 is an enlarged perspective view illustrating a bush structure 1 according to the present invention. The bush structure 1 is attached to lead-out parts 5*a* disposed at both ends of a remote part 5 of an earphone. A cable 4 of the earphone inserted through the remote part 5 is led out of the remote part 5 from the lead-out part 5*a*. FIG. 2 is a side view illustrating the bush structure 1. Note that FIGS. 1 and 2 illustrate a state in which a lid of the remote part 5 is open. FIG. 3A is a plan view of the bush structure 1 alone, and FIG. 3B is a cross-sectional view taken along an arrow A-A of FIG. 3A. FIG. 4A is a side view taken along an arrow B of FIG. 3A, and FIG. 4B is a side view taken along an arrow C of FIG. 3A.

As illustrated in FIGS. 3 and 4, the bush structure 1 has a bush body 2 located on a lead-out side of the cable and a retaining part 3 disposed below the bush body 2. The bush structure 1 has a two-layer structure of the bush body 2 and the retaining part 3.

Figure 4B:
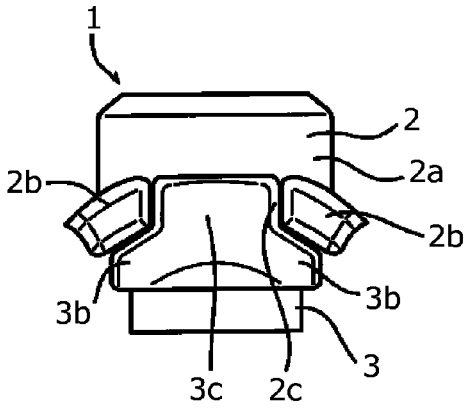
FIG. 4B is a side view taken along an arrow C of FIG. 3A.

The bush body 2 has a cylindrical part 2*a* with a through hole 2*a*2 (first through hole) as illustrated in FIG. 3B and flange parts 2*b* protruding leftward and rightward from the lower end part of the cylindrical part 2*a* as illustrated in FIG. 4B. An inner peripheral surface 2*a*1 of the through hole 2*a*2 is recessed in a mortar shape. The through hole 2*a*2 penetrates in a vertical direction.

The inner peripheral surface 2*a*1 of the through hole 2*a*2 (cylindrical part 2*a*) has a curved surface with a convex R shaped cross-section. For example, when the diameter of the cable 4 (sheath) is set to 2 mm, the curvature of the convex cross-section R is 1.57 mm.

Furthermore, a dimension of the mortar-shaped through hole 2*a*2 having a minimum diameter substantially coincides with the diameter of the cable 4.

Furthermore, as illustrated in FIG. 3B, the retaining part 3 has a through hole 3*a* (second through hole) disposed below the through hole 2*a*2. The through hole 3*a* is disposed such that the central axis of the through hole 3*a* coincides with the central axis of the through hole 2*a*2. The diameter of the through hole 3*a* coincides with the minimum diameter (diameter of the cable 4) of the through hole 2*a*2 of the bush body 2. The cable 4 is inserted and fitted into the through hole 3*a* and the through hole 2*a*2.

Furthermore, the retaining part 3 includes flange receiving parts 3*b* (locking parts) in which the flange parts 2*b* of the bush body 2 are disposed.

Note that, as illustrated in FIG. 4B, a convex part 3*c* of the retaining part 3 is inserted and fitted into (connected to) a concave part 2*c* of the bush body 2, so that the bush body 2 is engaged with the retaining part 3. The concave part 2*c* is formed (disposed) between a pair of flange parts 2*b* of the bush body 2. The convex part 3*c* is formed (disposed) between a pair of flange receiving parts 3*b* of the retaining part 3.

Then, the cable 4 is inserted and fitted into the through hole 2*a*2 of the bush body 2 and the through hole 3*a* of the retaining part 3. The flange part 2*b* is locked to a circular opening edge part 5*b* formed on the lead-out part 5*a* of the remote part 5 (a casing lid part of the remote part 5 is not illustrated in FIGS. 1 and 2). That is, the bush structure 1 is fitted to the opening edge part 5*b* of the remote part 5, and is attached to the remote part 5 in a state of not being easily detached from the remote part 5.

Figure 5A:
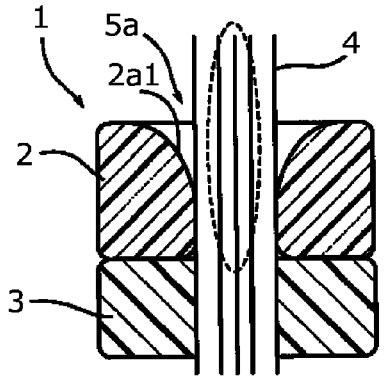
FIGS. 5A, 5B, and 5C are a cross-sectional view of the bush structure according to the present invention.

Note that the reason why the through hole 2*a*2 of the bush body 2 is formed in a mortar shape as described above is because the contact range of the cable 4 with respect to the inner peripheral surface 2*a*1 of the through hole 2*a*2 becomes longer in the axial direction of the cable 4 as indicated with the broken line in FIG. 5A (because a load applied to the cable 4 is distributed).

Figure 5B:
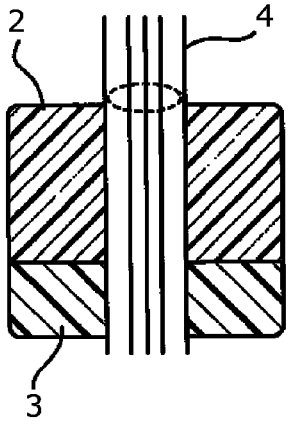
Figure 5C:
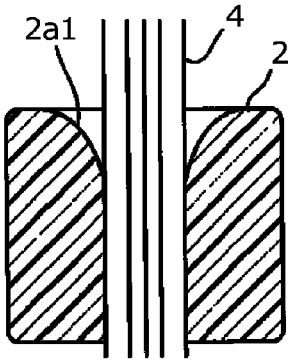

For example, as illustrated in FIG. 5B, when the through hole 2*a*2 is not formed in a mortar shape, contact points of the cable 4 with respect to the bush body 2 are concentrated at one point, and consequently disconnection of the cable 4 easily occurs.

Furthermore, in the present embodiment in which the through hole 2*a*2 of the bush structure 1, which serves as the lead-out part of the cable 4, is in a mortar shape, the bush structure 1 includes two members of the bush body 2 and the retaining part 3. This is because insert-molding the mortar-shaped through hole 2*a*2 only in the bush body 2 is easier than integrally insert-molding the entire bush structure 1 into a mortar shape, in view of the structure of a mold.

Furthermore, the bush body 2 can be made of a material different from that of the retaining part 3, since the bush structure 1 is provided with two members. That is, for example, the bush body 2 is made of thermoplastic elastomer (TPE) and the retaining part 3 is made of polypropylene (PP). In such a case, the bush body 2, which is disposed in a part where the cable 4 is loaded, is soft, and the retaining part 3, which is disposed in a part where the cable 4 is not loaded, is hard. Therefore, the performance of preventing the bush structure 1 from being detached from the remote part 5 is enhanced, and the bush body 2 absorbs a load applied to the cable 4.

Figure 6:
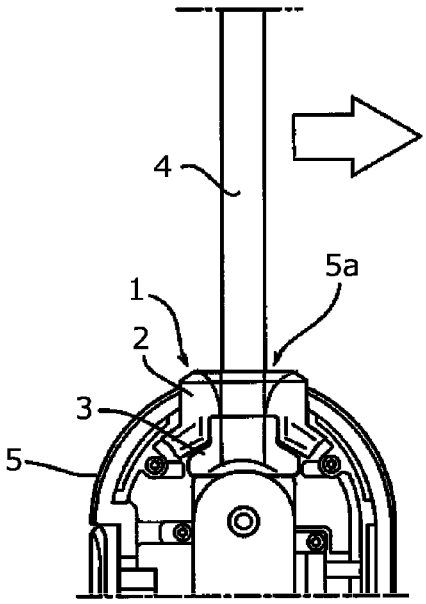
FIG. 6 is a cross-sectional view of the bush structure according to the present invention.

In the remote part 5 using the bush structure 1 configured as described above, for example, when the cable 4 is bent in the direction of an arrow as illustrated in FIG. 6, the contact range of the cable 4 with respect to the inner peripheral surface 2*a*1 of the mortar-shaped through hole 2*a*2 (within the range indicated with the broken line in FIG. 5A) is determined by an angle between the cable 4 and the inner peripheral surface 2*a*1 of the through hole 2*a*2.

That is, the contact range of the cable 4 with respect to the inner peripheral surface 2*a*1 of the through hole 2*a*2 becomes longer in the axial direction of the cable 4. Therefore, the disconnection of the cable 4 due to the concentration of the contact points of the cable 4 with respect to the bush body 2 at one point is prevented.

Figure 7:
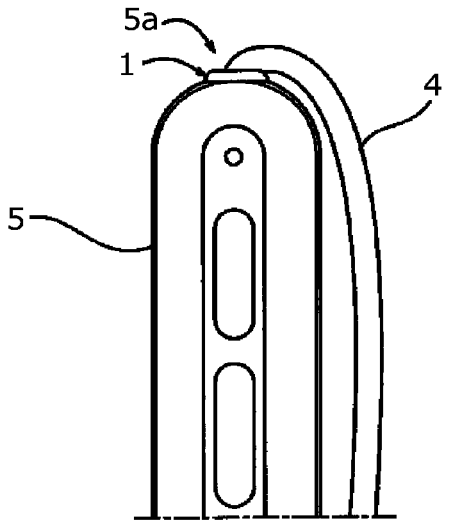
FIG. 7 is a side view of the bush structure according to the present invention.
Figure 8:
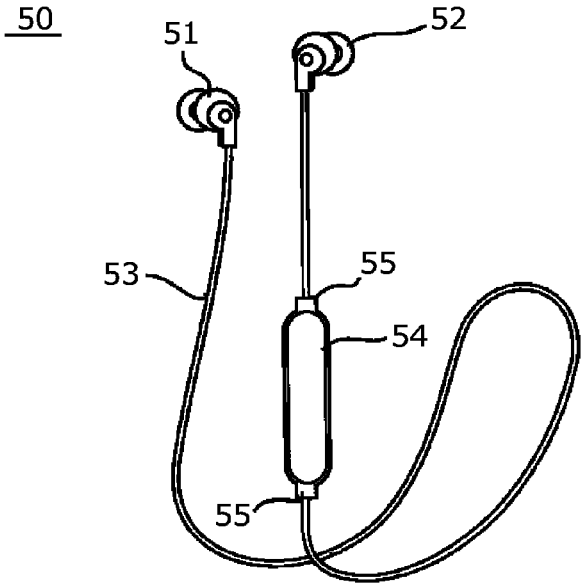
FIG. 8 is a front view of a semi-wireless earphone in the related art.
Figure 9:
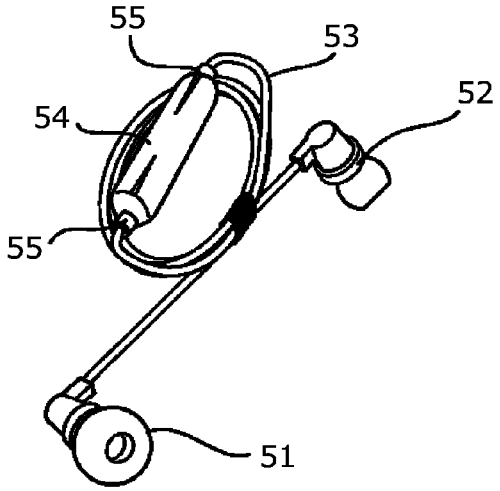
FIG. 9 is a perspective view of the semi-wireless earphone in the related art in a state in which a cable is bundled in a ring shape.
Figure 10:
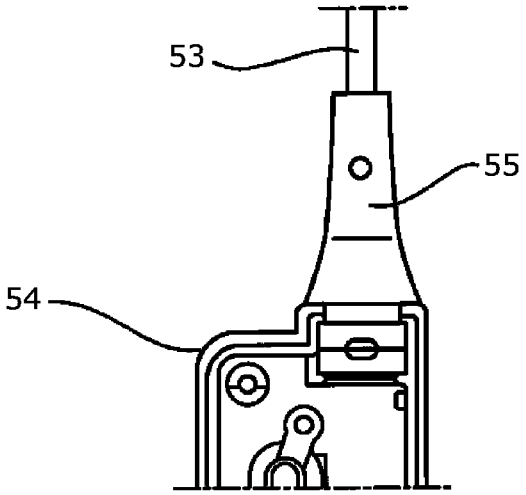
FIG. 10 is a side view of a bush structure in the related art.
Figure 11A:
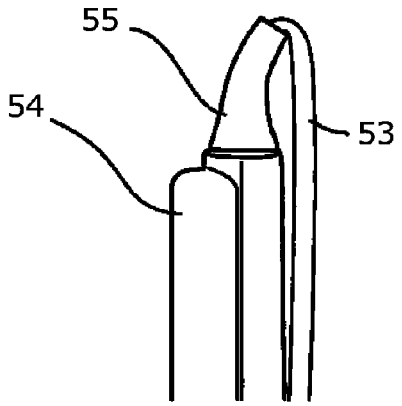
FIGS. 11A and 11B are a side view of the bush structure in the related art.
Figure 11B:
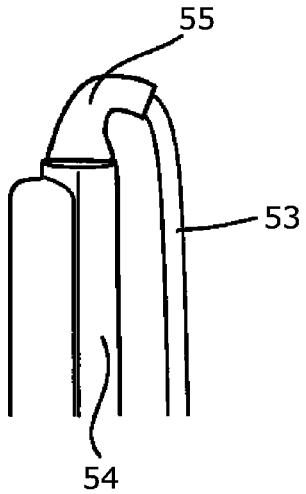

Furthermore, when the cable 4 is strongly wound around the remote part 5, even though the cable 4 is along the casing of the remote part 5 as illustrated in FIG. 7, the bent shape of the cable 4 is curved, since the lead-out part 5*a* has a mortar shape with a convex R shaped cross-section. Accordingly, a load applied to the cable 4 is distributed, so that the cable 4 is hardly disconnected.

According to the embodiment described above, the bush structure 1 according to the present invention includes the through hole 2*a*2 formed in a mortar shape with a diameter larger than the cable diameter and gradually increasing around the cable axis toward the lead-out direction of the cable 4 (upward in FIG. 3B) in the lead-out part 5*a* of the remote part 5.

Therefore, for example, when a user of a wireless earphone holds the remote part 5 with one hand and winds the cable 4 around the remote part 5 with the other hand, the cable 4 in the vicinity of the lead-out part 5*a* comes into contact with the inner peripheral surface 2*a*1 of the mortar-shaped through hole 2*a*2 of the bush structure 1 with a long line width. Accordingly, a load applied to the cable 4 in the vicinity of the lead-out part 5*a* is distributed, so that the disconnection of the cable 4 is prevented. Furthermore, particularly, since the inner peripheral surface 2*a*1 of the through hole 2*a*2 is formed to have a convex R shaped cross-section, the cable 4 is led out in a loosely curved state, and consequently sharp bending of the cable 4 is suppressed.

Furthermore, the shape of the bush structure 1 is not a convex shape protruding from the lead-out part 5*a* of the cable 4, but a concave shape. Therefore, the remote part 5, to which the bush structure 1 is attached, is not subjected to design restrictions such that the lead-out part 5*a* of the cable 4 has a bellows structure. That is, the degree of freedom in designing the remote part 5 and the like is increased, resulting in the improvement of the design property of a product including the remote part 5.

Moreover, the bush body 2, which is disposed in a part where the cable 4 is loaded, is formed to be soft, so that the bush body 2 absorbs a load applied to the cable 4. Furthermore, the retaining part 3, which is disposed in a part where the cable 4 is not loaded, is formed to be hard, so that the performance of preventing the bush structure 1 from being detached from the remote part 5 is enhanced.

Although the embodiment described above has a configuration in which the bush structure 1 is disposed in the lead-out parts 5*a* at both ends of the remote part 5, the bush structure according to the present invention is not limited to such a configuration. For example, in a case where a cable is led out of a battery part of a semi-wireless earphone and the like, the bush structure according to the present invention can be applied to the lead-out part.

Furthermore, although the embodiment described above is an example in which the bush structure according to the present invention is applied to a semi-wireless earphone, the application scene of the bush structure according to the present invention is not limited thereto and the bush structure according to the present invention can be applied to a lead-out part of a cable of any product, from which the cable is led out, regardless of genre.

The invention claimed is:

1. A bush structure provided to a lead-out part of a cable in a remote part of an earphone, the bush structure comprising:

a bush body provided to the lead-out part and a first through hole through which the cable is inserted formed in the bush body; and a retaining part connectable to a bottom of the bush body, wherein the first through hole gradually expands in diameter toward a lead-out direction of the cable, and the retaining part is formed of a material harder than the bush body and includes a second through hole to be communicated with the first through hole and into which the cable is inserted, and a locking part to be locked to the lead-out part;

wherein the bush body includes a flange part protruding leftward and rightward from a lower end portion of the first through hole, the retaining part includes a flange receiving part in which the flange part is disposed, and when the cable is pulled in the lead-out direction, the retaining part is pulled up and the flange part is fitted to an opening edge part formed in the lead-out part.

2. The bush structure according to claim 1, wherein an inner peripheral surface of the first through hole is formed to have a convex R shaped cross-section.

3. The bush structure according to claim 1, wherein the bush body is made of thermoplastic elastomer, and the retaining part is made of polypropylene.

4. The bush structure according to claim 2, wherein the bush body is made of thermoplastic elastomer, and the retaining part is made of polypropylene.

* * * * *